United States Patent [19]

Ardiente

[11] 4,245,779

[45] Jan. 20, 1981

[54] SYSTEM FOR INCREASING HEATING EFFICIENCY

[76] Inventor: Nestor P. Ardiente, 15314 Bunker Dr., Orland Park, Ill. 60462

[21] Appl. No.: 16,100

[22] Filed: Feb. 28, 1979

[51] Int. Cl.[3] ..... F23N 3/00; G05D 23/00; F23L 11/00; F23J 13/00

[52] U.S. Cl. ..... 236/1 G; 431/20; 126/285 B; 98/48

[58] Field of Search ..... 236/1 G, 11, 10; 431/20; 126/285 B, 85 B; 98/48; 237/53

[56] References Cited

U.S. PATENT DOCUMENTS

| | | | |
|---|---|---|---|
| 2,877,834 | 3/1959 | Campbell | 431/20 X |
| 3,906,925 | 9/1975 | Dyer | 236/10 X |

*Primary Examiner*—William E. Wayner
*Assistant Examiner*—Harry Tanner
*Attorney, Agent, or Firm*—Laff, Whitesel & Rockman

[57] ABSTRACT

A conventional forced air furnace is provided with a source of outside air for use in combustion. The amount of outside air admitted to the furnace and the amount of heated air lost through the chimney are regulated by simultaneously operable dampers synchronized with the operation of the furnace. Alternate power circuits and an alarm system for the dampers are provided.

3 Claims, 2 Drawing Figures

SYSTEM FOR INCREASING HEATING EFFICIENCY

BACKGROUND OF THE INVENTION

This invention relates to heating efficiency and, more particularly, to a system for increasing furnace efficiency.

The recent public concern over fuel consumption in this country and throughout the world has emphasized the importance of energy efficient appliances. One particular device which uses substantial energy is the ordinary furnace for home or business. The commonly used oil and gas fired forced air furnaces consume substantial quantities of natural resources in short supply.

Furnace efficiency, however, is affected by external factors as well as its internal construction. Most forced air furnaces use air from the surrounding room for combustion. This promotes a draft within the building because air from elsewhere within the building moves to replace the air used in combustion. Also, cold air from outside the building is drawn through the cracks in the building and through the window and door frames to further create drafts. The end result is a decrease in the heating efficiency of the furnace and an increase in fuel consumption.

One solution to this problem is to supply outside air, rather than room air, directly into the furnace for combustion, as suggested in the following U.S. Pat. Nos. 4,038,963; 3,805,764; 3,906,925; 2,711,683; 2,764,972. However, previous efforts to supply outside air for combustion have not proven satisfactory because the amount of cold outside air entering the furnace has not been adequately controlled.

A further problem contributing to furnace inefficiency is the unnecessary loss of heat through the chimney flue or exhaust. When the furnace is shut off, residual heat promotes convection currents which cause warm air drawn from the furnace room to leave through the chimney. A manually operated damper located in the flue has proven cumbersome, impractical and undependable because it must be opened or shut each time the furnace operates or shuts off. U.S. Pat. No. 3,906,925 has suggested a motor driven damper activated by the furnace thermostat, but this unnecessarily complicated system apparently depends on the special damper motor and lacks a back-up method of operating the damper. Thus, it is subject to the danger of a heat build-up due to a closed damper and an operating furnace in the event of a malfunction.

BRIEF SUMMARY OF THE INVENTION

In keeping with one aspect of the invention, a duct is provided between the combustion chamber of a forced air furnace and the outside of the building to supply outside, unheated air for combustion. A damper is positioned within this duct to control the supply of outside air. An additional damper is provided within the flue or exhaust duct leading from the furnace through the chimney. The dampers are mounted on a common shaft to provide simultaneous operation of both. The dampers are activated electrically and in synchronization with the thermostat controlling the furnace. A back-up power circuit for the dampers is provided by the circuit including the furnace blower. In addition, the dampers can be operated manually.

The above mentioned and other features of this invention and the manner of obtaining them will become more apparent, and the invention itself will be best understood by reference to the following description of an embodiment of the invention taken in conjunction with the accompanying drawings.

DETAILED DESCRIPTION OF THE INVENTION

Figure 1:
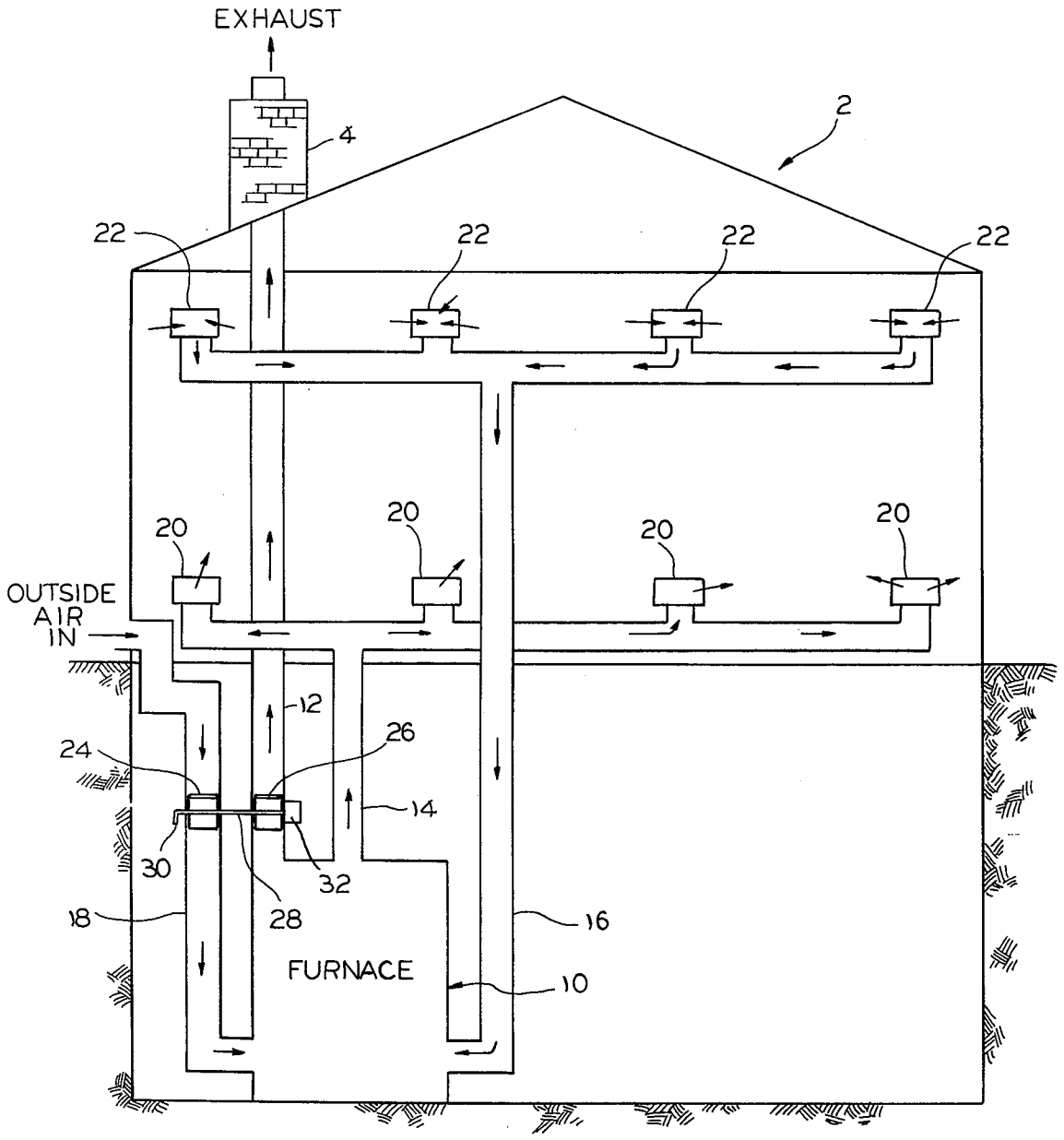
FIG. 1 is a cross sectional view of a house having a heating system which incorporates the invention.

As shown in FIG. 1, a system for increasing heating efficiency in accordance with the teachings of this invention employs a conventional oil or gas fired forced air furnace 10. For illustration purposes, the furnace is shown in the basement of a home 2, but neither the location of the furnace nor the type of structure to be heated are critical to the invention. The furnace has the three conventional ducts 12, 14 and 16 leading to and from the furnace. Duct 12 is an exhaust duct leading from the furnace through the chimney 4 and carries the end products of combustion from the furnace to the ambient atmosphere. Duct 14 carries air heated by the furnace to various areas of the house, where the air is released through vents 20. Duct 16 returns cooled air, which enters the duct through vents 22 in the rooms of the house, to the furnace.

Most conventional furnaces simply draw air from the basement or room in which they are situated for combustion. However, the present invention includes a fourth duct 18 leading between the furnace and the outside of the house. Duct 18 provides outside air to the furnace for combustion. Thus, with this source of outside air, convection currents caused by the draw of air by the furnace for combustion are diminished, and the influx of cold outside air through door and window frames is reduced.

This invention also provides means for controlling the infiltration of cold air through duct 18 and the escape of heated air through exhaust duct 12. A pair of dampers 24 and 26 are positioned within ducts 12 and 18. The dampers are capable of obstructing or permitting the free flow of air through the ducts. Desirably, the dampers are pieces of sheet metal shaped to correspond to the cross-section of the duct—usually rectangular. Preferably, dampers 24 and 26 are mounted on a rotatable common shaft 28 which positions the dampers to obstruct or permit air flow through the ducts. The shaft can be rotated either manually, as by handle 30, or electro-mechanically, as by control box 32.

Figure 2:
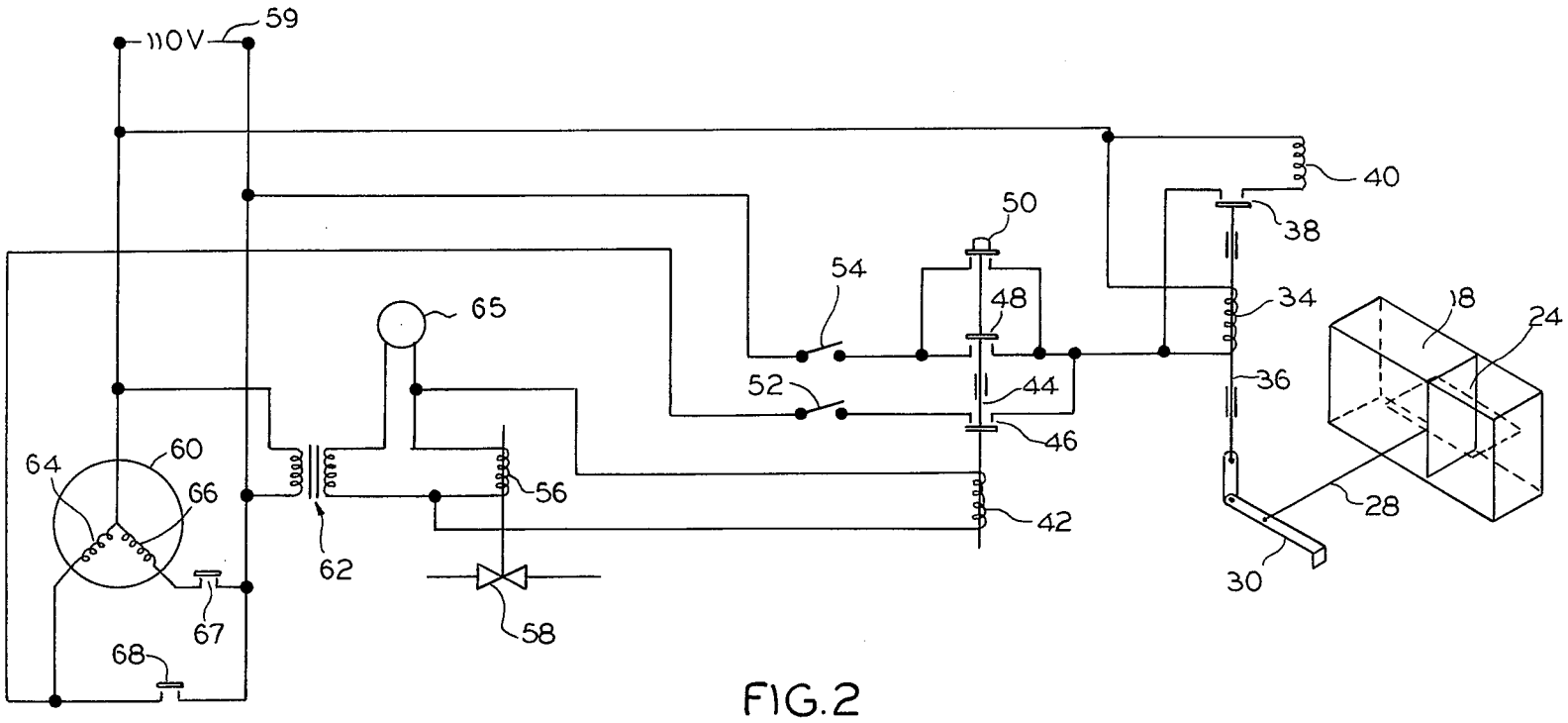
FIG. 2 is a circuit diagram of the control box and the existing wiring of the furnace, together with a perspective view of the outside air duct as constructed according to the invention.

FIG. 2 shows in more detail the rotation means 28 and 32 and damper 24 within a portion of duct 18. If desired, handle 30 can be turned so as to rotate shaft 28 and position damper 24 perpendicular to, or parallel to, the flow of air in duct 18.

FIG. 2 also shows the contents of control box 32 in relationship to existing wiring and components of a conventional forced air furnace. Box 32 contains a first solenoid 34 with a core 36 attached to handle 30 of shaft 28. Connected to the solenoid and core are a switch 38 and a buzzer or alarm 40. Box 32 also contains a second solenoid 42 with a spring loaded core 44 which operates switches 46 and 48. When the second solenoid 42 is not energized, switch 48 is open and switch 46 is closed. A test button switch 50 is wired across switch 48 and is accessible from the outside of control box 32. Power on-off switches 52 and 54 are connected to switches 46 and 48 respectively.

These components of control box 32 are appropriately connected to existing wiring of the furnace system. Solenoid 42 is wired across a third solenoid 56 which controls the fuel gas or oil supply valve 58. Buzzer 40 is connected to the 110 volt power supply 59 which leads directly to the furnace fan motor 60. Power on-off switch 54 is connected to the 110 volt power supply which leads to the stepdown transformer 62. Power on-off switch 52 is connected to the low speed motor winding 64 of fan motor 60. Both of the power switches are normally maintained in the "on" position.

With the above described improvements, the heating efficiency of an ordinary forced air furnace will be significantly increased in a safe and reliable manner. Under ordinary circumstances, the house or room thermostat 65 will control the activation of the furnace by energizing solenoid 56 which opens oil or gas supply valve 58. Simultaneously, solenoid 42 is energized, thereby closing switch 48 and opening switch 46.

When switch 48 is closed, solenoid 34 is activated so as to rotate shaft 28 and position dampers 24 and 26 to allow the free flow of air through ducts 18 and 12. Also, the activation of solenoid 34 opens switch 38, thereby preventing the buzzer 40 from activating. When the thermostat cuts power to the solenoids, the dampers return to the closed position and obstruct air flow in the ducts.

If the room thermostat fails to directly activate the dampers, a back-up power circuit derived from the furnace fan is automatically employed to open the dampers. In most conventional forced air furnaces, the furnace fan is activated by a special thermostat (not shown) which often operates the fan even after the furnace shuts off to eliminate residual heat. The low speed winding 64 of the furnace fan motor 60 operates only for the heating system. If a central air conditioning system is joined to the same motor, only the high speed winding 66 operates during operation of the air conditioner. In either case, the high speed winding is isolated from the heating system by switch 67. Once the furnace thermostat activates the low speed winding through switch 68, power flows through power on-off switch 52, bypassing switches 54 and 48, to solenoid 34, which opens the dampers. Of course, if the thermostat actually energized solenoid 42, as would normally occur, switch 46 would open and power would flow to solenoid 34 and the dampers through power on-off switch 54.

Test button 50 controls power to the dampers independently of the thermostat. Thus, it can be used to test the operation of the dampers and also to insure that power is available to the system from the 110 volt power supply. Should a malfunction occur whereby solenoid 34 fails to energize and open the dampers, power from the furnace fan circuit will activate alarm 40 through closed switches 38 and either 46 or 48. If necessary, handle 30 can be used to manually override the electrical circuits and control the operation of the dampers.

The many advantages of this system are apparent. First, the invention provides a compact system for increasing heating efficiency which is adaptable to the existing construction of conventional forced air furnaces. Second, cold air infiltration through the windows and door frames and cold air accumulation around the furnace are reduced, and warm air surrounding the furnace which is otherwise lost through the chimney is conserved. Third, the system provides coordinated and simultaneous control of dampers in the outside air and exhaust ducts. Fourth, two alternate power circuits plus a manual override control for the dampers provides reliability and safety. Fifth, the alarm and testing controls built into the system actively monitor the operation of the system and provide added security.

While the principles of the invention have been described above in connection with specific apparatus and applications, it is to be understood that this description is made only by way of example and not as a limitation on the scope of the invention.

I claim:

1. A system for increasing the efficiency of a thermostat controlled forced-air type of furnace having an exhaust duct, a hot air duct, and a cool air return duct, comprising: means for providing the furnace with outside air for combustion; movable dampers for regulating the air flow from the outside and through said exhaust duct; a rotatable shaft fixed to said dampers; a solenoid connected to said shaft and capable of rotating it when the solenoid is energized; a first electrical power circuit activated directly by the thermostat for energizing the solenoid; a second electrical power circuit activated when the furnace blower operates for energizing the solenoid if the first power circuit fails to do so; and means for manually rotating said shaft independently of the first and second power circuits, whereby said dampers are positioned by said shaft to obstruct air flow when the furnace is not operating and positioned to permit air flow when the furnace is operating.

2. The system of claim 1 including the additional elements of an alarm which is activated when the furnace is operating and the dampers are obstructing air flow, and a switch for activating said first electrical power circuit independently of the thermostat to test the operation of said dampers.

3. A system for increasing the efficiency of a thermostat controlled, forced-air type of furnace having an exhaust duct, a hot air duct, and a cool air duct comprising:

(a) a duct providing the furnace with outside air for combustion;

(b) rotatable dampers located in the outside air duct and the exhaust duct;

(c) rotation means for simultaneously positioning both dampers to block air flow when the furnace is not operating and to permit unobstructed air flow when the furnace is operating;

(d) a first electrical power circuit activated by said thermostat and connected with said rotation means to rotate said dampers to the appropriate position;

(e) an alternate electrical power circuit activated by said furnace and connected with said rotation means to rotate said dampers to the appropriate position in the event the first electrical power circuit fails to rotate said dampers; and (f) a manually operated handle connected to said rotation means to override said electrical power circuits and permit manual positioning of the dampers.

* * * * *